US005895331A

United States Patent [19]

Rinehart

[11] Patent Number: 5,895,331

[45] Date of Patent: Apr. 20, 1999

[54] CUSTOM DARTS AND THEIR MANUFACTURE

[75] Inventor: Timothy L. Rinehart, Parkersburg, W. Va.

[73] Assignee: Woodcraft Supply Corporation, W. Va.

[21] Appl. No.: 08/928,251

[22] Filed: Sep. 12, 1997

[51] Int. Cl.[6] ..... A63B 65/02

[52] U.S. Cl. ..... 473/578; 473/585

[58] Field of Search ..... 473/578, 582, 473/585, 586, FOR 216, FOR 219, FOR 220, FOR 223

[56] References Cited

U.S. PATENT DOCUMENTS

| | | | |
|---|---|---|---|
| 3,957,271 | 5/1976 | Kurtz et al. . | |
| 4,032,147 | 6/1977 | Sheldon | 473/578 |
| 4,212,464 | 7/1980 | Pelouch . | |
| 4,885,800 | 12/1989 | Ragle | 473/578 X |
| 5,009,433 | 4/1991 | Reid . | |
| 5,118,117 | 6/1992 | Denen | 473/585 |
| 5,157,405 | 10/1992 | Wycoff et al. | 473/578 X |
| 5,498,004 | 3/1996 | Mariella et al. . | |

FOREIGN PATENT DOCUMENTS

| | | | |
|---|---|---|---|
| 2009605 | 6/1979 | United Kingdom | 473/FOR 216 |
| 2 049 488 | 12/1980 | United Kingdom . | |
| 1590954 | 6/1981 | United Kingdom . | |
| 2 102 296 | 2/1983 | United Kingdom . | |
| 2224452 | 5/1990 | United Kingdom | 473/FOR 219 |

*Primary Examiner*—John A. Ricci
*Attorney, Agent, or Firm*—Cesari and McKenna, LLP

[57] ABSTRACT

A custom dart has a tubular body having opposite open ends and an interior wall. A nose piece closes one end of the body and a wad of relatively heavy malleable material is packed into the open end of the tube so that the material conforms substantially to the interior wall of the body and forms a fixed plug which fills a selected interior segment of the body. Then, a tail piece is secured to so as to close the other end of the body following which a dart point is attached to the nose piece and a flight shaft is attached to the tail piece.

13 Claims, 1 Drawing Sheet

CUSTOM DARTS AND THEIR MANUFACTURE

This invention relates to a dart of the type thrown by hand to a dart board. It relates also to a method of making a dart of this type.

BACKGROUND OF THE INVENTION

A dart generally consists of a body, the leading end of which carries a needle-like point which is to penetrate the dart board and the trailing end of which leads to a flight shaft terminated by a flight. The body is usually thicker and heavier than the flight shaft to facilitate throwing the dart and to position the dart's center of gravity at the desired location along the dart.

Usually the dart body and shaft are separately turned or formed parts which may be threadedly connected together. Some darts also have their tips threadedly connected to the leading end of the dart body. This enables the different parts of the darts to be made of different materials. For example, the dart body may be made of wood or metal and the flight shaft of a relatively lightweight plastic material. The dart point is usually of steel when the dart is to be thrown at a conventional dart board. On the other hand, a dart used with an electronic dart board may have a plastic point.

A dart having a solid body is disadvantaged in that its weight and center of gravity or balance is determined at the time of manufacture. Therefore, a dart which may have satisfactory weight and balance for one player may not suit another player.

To solve this problem, darts have been developed whose overall weight characteristics can be adjusted. For example U.S. Pat. No. 3,957,271 describes a dart to which annular weights may be added to control the overall weight and length characteristics of the dart. On the other hand, U.S. Pat. No. 5,009,433 and British Specification 1 590 954 disclose darts having an internal cavity which may be partially or completely filled with metal balls or particles. In the case of the former dart, the internal weight functions as a moveable ballast which moves from the tail of the dart toward the point upon impact with the dart board to assist in the adherence of the dart to the dartboard.

Such prior adjustable darts have not been entirely satisfactory for a variety of reasons. Some are relatively complicated and expensive to manufacture. Others are composed of several small parts which can become loose and upset the flight characteristics of the darts. Still other prior darts cannot be customized as to dart length.

SUMMARY OF THE INVENTION

Accordingly, the present invention aims to provide a dart which can be customized with respect to dart length, weight and balance.

Another object of the invention is to provide such a dart which has a minimum number of parts which are all relatively easy and inexpensive to make in quantity.

Yet another object of the invention is to provide a dart which can be sold in kit form for assembly by the user to his/her own specifications vis a vis body length, weight and balance.

Still another object is to provide a custom dart whose flight characteristics do not change appreciably over time.

A further object of the invention is to provide a method of making a dart having one or more of the above advantages.

The invention accordingly comprises the several steps and the relation of one or more of such steps with respect to each of the others, and the dart possessing the features, properties and relation of elements, which are exemplified in the following detailed description, and the scope of the invention will be indicated in the claims.

Briefly, my dart has a body comprising an elongated tube and a hard but somewhat pliable material such as brass. A nose bushing is secured one end of the tube. Then, a weighed amount of a relatively heavy, highly malleable ballast material such as lead wool is inserted into the tube through its opposite end and packed down against the closed end of the tube until the material forms a solid immobile plug adjacent the closed end of the tube. Then a tail bushing is secured to the open end of the tube.

The dart also includes a needle-like point releasably connected to the nose bushing and a flight shaft with a flight releasably connected to the tail bushing, all of the aforesaid dart components being in axial alignment and having axial symmetry.

If desired, a wood or plastic sleeve may surround the tube between the bushings to dress up the exterior of the dart body and give it the desired aerodynamic shape.

It is a feature of the invention that all of the components of the dart can be sold in the form of a kit for assembly by the dart user. The user can thus customize the overall length of the dart by changing the length of the body tube. Also, the weight and balance of the dart can be adjusted to suit the user by controlling the amount and placement of the ballast within the tube.

All of the components of the dart are simple machined or molded parts which can be made in quantity relatively easily and inexpensively. Furthermore, those components may be assembled by the user with a minimum of effort. Therefore, the dart should find wide acceptance wherever the game of darts is played.

BRIEF DESCRIPTION OF THE DRAWINGS

For a full understanding of the nature and objects of the invention, reference should be had to the following detailed description taken in connection with the accompanying drawings, in which.

DETAILED DESCRIPTION OF AN ILLUSTRATIVE EMBODIMENT

Figure 1:
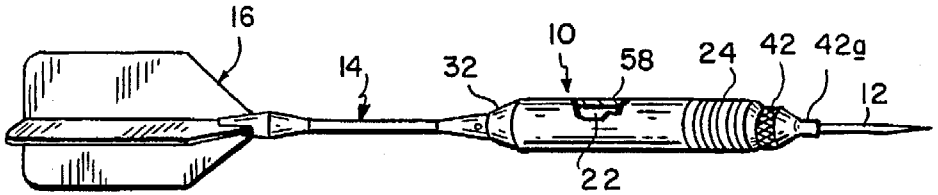
FIG. 1 is a perspective view with parts broken away showing a dart incorporating the invention.

Referring to FIG. 1 of the drawings, the dart includes a generally cylindrical body 10. A needle like point 12 extends from the leading end of the body 10 and a long tapered flight shaft 14 extends from the rear end of that body, the trailing end of the shaft being terminated by a flight 16.

Figure 2:
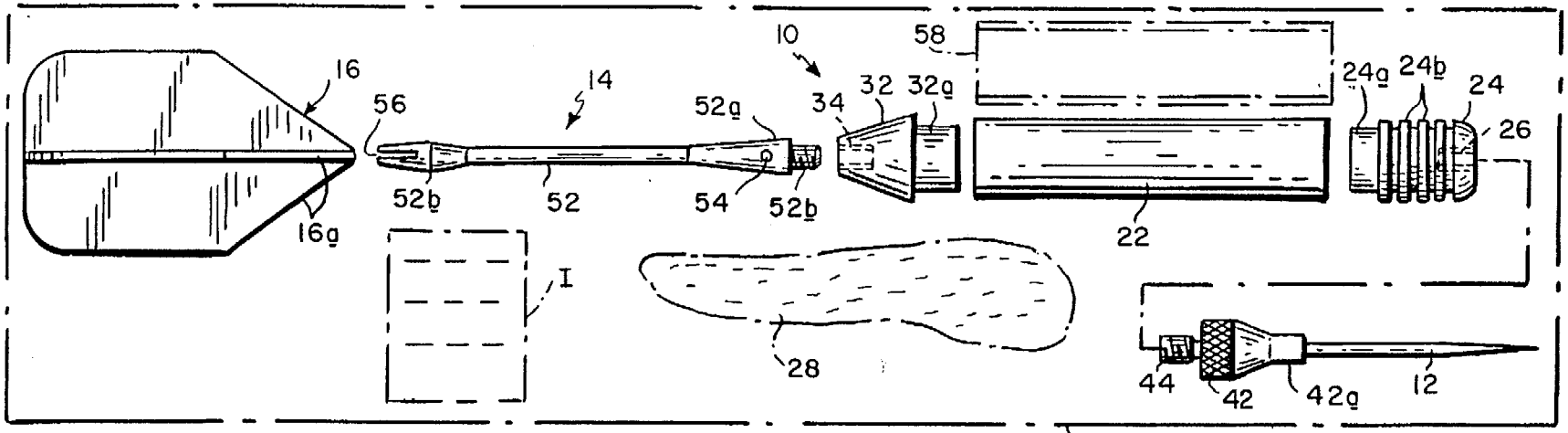
FIG. 2 is an exploded side elevational view showing the components of the FIG. 1 dart in greater detail and packaged as a kit.

Refer now to FIG. 2 which shows the components of the dart in greater detail. Those components may be supplied as a kit in a package P along with assembly instructions I.

As shown in FIG. 2, the body 10 of the dart includes a relatively long, thin-wall cylindrical tube 22 of a strong but pliable material such as brass, although certain plastics will do too. Body 10 also includes a solid brass nose bushing 24 having a reduced diameter neck 24*a* whose diameter is substantially the same as the interior diameter of tube 22 so that the bushing can be press fit into the leading end of the tube as shown in FIG. 1. Preferably also, bushing 24 is provided with a plurality of circumferential ribs 24*b* to provide a gripping surface on the dart. Also, an axial threaded passage 26 is provided at the leading end of the bushing 24 by which the dart's point 12 maybe releasably connected to that bushing as will be described.

Figure 3:
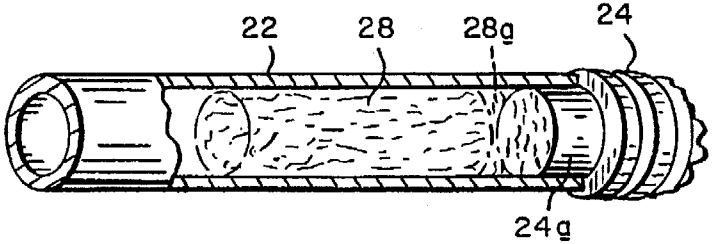
FIG. 3 is a fragmentary perspective view on a larger scale showing the FIG. 1 dart body in greater detail.

Referring to FIGS. 2 and 3, package P includes a supply of heavy, very malleable ballast material 28. In the illustrated embodiment, ballast 28 is a mass of lead wool which is the same material used to seal pipe joints. When tamped in place, it deforms and conforms almost exactly to the space in which it is packed to form a solid immobile plug which adheres to the walls of that space. Other possible ballast materials are lead flakes and particles.

The components of body 10 in package P also include a sold brass conical tail bushing 32 having a reduced diameter neck 32*a* which may be press fit into the tail end of tube 22. The bushing 32 has a threaded passage 34 in its rear or outer end by which the shaft 14 is releasably attached to body 10.

Still referring to FIG. 2, point 12 has a base 42 with a threaded shaft 44 which is arranged to screw into the passage 26 in nose bushing 24. To facilitate this, flats 42*a* may be provided in base 42 by which the base may be turned on its axis by a suitable wrench.

The shaft 14 in package P has a relatively long, somewhat flexible molded plastic stem 52. The forward end 52*a* of the stem is enlarged to accommodate a threaded end segment 52*b* which can be threaded into the passage 34 and the tail bushing 32. To facilitate this, a diametric hole 54 is provided in the stem end 52*a* for receiving a lever pin (not shown) by which the shaft 14 may be rotated about its axis.

Formed at an enlarged trailing end 52*b* of stem 52 is a pair of orthogonal slots 56 which extend in from the trailing end of the stem. The slots are arranged to snugly receive the orthogonal fins 16*a* of flight 16 so that the flight may be releasably attached to the shaft.

The kit package P may also include a sleeve 58 shown in phantom in FIG. 2 which may be slid onto tube 22 and secured thereto, e.g., by epoxy cement, prior to installing tail bushing 32 to finish off the dart body 10. The sleeve may be made of a suitable durable decorative material such as wood or plastic. Alternatively the sleeve may be fabricated on a lathe by the purchaser of the custom dart kit P. In that event, the sleeve ends should have the same outside diameters as the maximum diameters of the bushings 24 and 32; otherwise, the sleeve profile may be shaped to suit the user.

To assemble the dart, the nose bushing 24 is press fit into one end of tube 22. Depending upon the overall length of the dart desired by the user, the tube (and sleeve 58, if applicable) may be shortened as needed using a hacksaw. Then, a wad of the lead wool ballast 28 is inserted into the open end of tube 22 and compacted against the inner end of bushing 24 as shown in FIG. 3.

To accomplish this, the tube may be positioned on a piece of wood, nose bushing down, and an appropriately sized (e.g., ¼ in.) rod or old drill bit inserted into the open end of the tube. By tapping on the rod with a hammer or mallet, the lead wool ballast may be packed tightly into the nose end of the tube. The lead wool is very malleable such that it deforms and conforms exactly to the internal shape of tube 22 almost becoming welded to the tube wall thereby forming an immovable plug within the tube.

Ballast is added in small amounts until the dart has the desired total weight. To determine this, all the dart components, although mostly disassembled at this point, should be weighed collectively each time ballast material is added until the selected weight is reached.

If it is desired that the center of gravity of the dart be located further toward the flight shaft 14 without increasing the overall weight of the dart, cotton wadding 28*a* may be packed into the tube 22 ahead of the lead wool as shown in FIG. 3.

Alternatively, the tail bushing 32 may be attached to tube 22 first and the ballast packed into the front or head end of the tube.

After all the ballast has been tamped in place, the tail bushing is press fit into the open end of the tube thereby completely enclosing the tube interior. Then, the shaft 52 is screwed into the threaded opening 34 in the tail bushing 32 and tightened using a suitable rod or pin inserted into the shaft opening 54.

Finally, the flight 16, which usually lies flat in package P, is opened up so that its fins lie at right angles and the fins are slid into the slots 56 at the trailing end of shaft 52 and finally the point 12 is screwed onto the nose bushing 24 and tightened using a suitable wrench.

Thus, the assembled dart may be customized to the user's satisfaction in terms of overall length, weight and balance or center of gravity. Therefore, the dart helps to optimize the user's game play.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A custom dart comprising a tubular body having opposite open ends and an interior wall;

a nose piece secured to and closing one end of said body;

a wad of relatively heavy malleable lead wool packed in said tube so that the material conforms substantially to the interior wall of the tube and forms a fixed plug which fills a selected interior segment of the tube;

a tail piece secured to and closing the other end of the body;

a dart point removably attached to the nose piece, and a flight shaft carrying a flight and removably attached to the tail piece.

2. The dart defined in claim 1 wherein the nose piece and tail piece comprise bushings which are press fit into the opposite ends of the body.

3. The dart defined in claim 2 wherein said bushings have coaxial threaded passages and the point and flight shaft are threadedly connected to different ones of said bushings.

4. The dart defined in claim 1 wherein the body comprises a rigid tube and an outer sleeve surrounding said tube.

5. The dart defined in claim 4 wherein said sleeve is of wood.

6. A custom dart in the form of a kit comprising:

a hollow metal tube having opposite ends;

a nose bushing adapted to be press fit into one end of the tube;

a tail bushing adapted to be pressed into the other end of the tube, each bushing having an axial threaded passage;

a mass of lead wool;

a dart point having a threaded end adapted to be screwed into the threaded passage in the nose bushing;

a flight shaft having a slotted end and a threaded end adapted to be screwed into the passage in the tail bushing, and a flight having a plurality of fins adapted to be engaged to the slotted end of the shaft.

7. The dart defined in claim 6 and further including a sleeve dimensioned to snugly surround said tube.

8. The dart defined in claim 6 wherein the tube and bushings are of brass and the flight shaft is of a plastic material.

9. A method of making a custom dart comprising selecting an elongated tube having opposite ends and an interior wall;

cutting the tube to a selected length commensurate with the desired overall length of the dart;

press fitting a first bushing into one end of the tube;

tightly packing a very malleable material into the tube through its other end so that the material forms an essentially solid immovable plug which conforms substantially exactly to the interior wall of the tube;

press fitting a second bushing into the other end of the tube;

attaching a dart point to one of said first and second bushings, and attaching a flight shaft carrying a flight to the other of said first and second bushings so that the dart point and flight shaft are collinear.

10. The method defined in claim 9 and including the additional step of sliding a snugly fitting sleeve onto the tube before press fitting the second bushing into the other end of the tube.

11. The method defined in claim 9 wherein the first bushing is a nose bushing and the second bushing is a tail bushing.

12. A method of making a custom dart comprising forming an elongated tube having opposite ends and an interior wall;

press fitting a first bushing into one end of the tube;

packing a wad of a relatively light-weight material into the tube through the other end thereof;

tightly packing a very malleable material into the tube through said other end behind the wad so that the material forms an essentially solid immovable plug which conforms substantially exactly to the interior wall of the tube;

press fitting a second bushing into the other end of the tube;

attaching a dart point to one of said first and second bushings, and attaching a flight shaft carrying a flight to the other of said first and second bushings so that the dart point and flight shaft are collinear.

13. The method defined in claim 9 including selecting the malleable material from the group consisting of lead wool, lead flakes and lead particles.

* * * * *